US007250450B2

(12) United States Patent
Fenouil et al.

(10) Patent No.: US 7,250,450 B2
(45) Date of Patent: Jul. 31, 2007

(54) PROCESS FOR THE PRODUCTION OF HYDROCARBONS FROM GASEOUS HYDROCARBONACEOUS FEED

(75) Inventors: Laurent Alain Fenouil, London (GB); Joannes Ignatius Geijsel, The Hague (NL); Abdul Razak Mohamad Ali, The Hague (NL)

(73) Assignee: Shell Oil Company, Houston, TX (US)

( * ) Notice: Subject to any disclaimer, the term of this patent is extended or adjusted under 35 U.S.C. 154(b) by 164 days.

(21) Appl. No.: 10/516,805

(22) PCT Filed: Jun. 5, 2003

(86) PCT No.: PCT/EP03/05962

§ 371 (c)(1),
(2), (4) Date: Dec. 3, 2004

(87) PCT Pub. No.: WO03/104355

PCT Pub. Date: Dec. 18, 2003

(65) Prior Publication Data

US 2005/0245619 A1 Nov. 3, 2005

(30) Foreign Application Priority Data

Jun. 5, 2002 (EP) ..... 02253912

(51) Int. Cl.
*C07C 27/00* (2006.01)
*C10G 47/00* (2006.01)

(52) U.S. Cl. ..... 518/705; 518/702; 518/703; 518/715; 208/58

(58) Field of Classification Search ..... 518/702–705, 518/715; 208/58
See application file for complete search history.

(56) References Cited

U.S. PATENT DOCUMENTS

| | | | | |
|---|---|---|---|---|
| 2,243,869 | A | 6/1941 | Keith, Jr. et al. | 196/10 |
| 4,046,829 | A | 9/1977 | Ireland et al. | 260/676 |
| 4,433,065 | A | 2/1984 | van der Burgt et al. | 518/703 |
| 5,324,335 | A | 6/1994 | Benham et al. | 44/452 |
| 5,958,985 | A | 9/1999 | Geerlings et al. | 518/700 |
| 2002/0120017 | A1* | 8/2002 | Bohn et al. | 518/703 |

FOREIGN PATENT DOCUMENTS

| | | |
|---|---|---|
| GB | 957260 | 5/1964 |
| GB | 965358 | 7/1964 |
| GB | 972140 | 10/1964 |
| GB | 1131989 | 10/1968 |
| GB | 1444936 | 8/1976 |
| JP | 63243194 | * 10/1988 |
| NL | 8303911 | 6/1985 |
| WO | 93/06041 | 4/1993 |
| WO | 01/96264 | 12/2001 |

OTHER PUBLICATIONS

International Search Report dated Nov. 7, 2003.
C.J. Kuhre, et al. Partial Oxidation Grows Stronger in U.S., Oil and Gas Journal, vol. 69, No. 36, Sep. 6, 1971.

* cited by examiner

*Primary Examiner*—J. Parsa

(57) ABSTRACT

A process for the production of hydrocarbons from gaseous hydrocarbonaceous feed involving the steps of:

i) partial oxidation conversion of the gaseous hydrocarbonaceous feed and oxygen containing gas at elevated temperature and pressure into synthesis gas;

ii) catalytical conversion of synthesis gas of step i) using a cobalt based Fischer-Tropsch catalyst into a hydrocarbons comprising stream;

iii) separating the hydrocarbons comprising stream of step ii) into a hydrocarbons product stream and a recycle stream; and, iv) removing carbon dioxide from the recycle stream and recycle of carbon dioxide depleted recycle stream to step i).

17 Claims, No Drawings

PROCESS FOR THE PRODUCTION OF HYDROCARBONS FROM GASEOUS HYDROCARBONACEOUS FEED

PRIORITY CLAIM

The present application claims priority on European Patent Application 022539126.1 filed 5 Jun. 2002.

FIELD OF THE INVENTION

The present invention relates to a process for the production of hydrocarbons from gaseous hydrocarbonaceous feed.

BACKGROUND OF THE INVENTION

This process comprises in general the conversion of a hydrocarbonaceous feed by partial oxidation using an oxygen containing gas into synthesis gas. Subsequently, this synthesis gas is catalytically converted into hydrocarbons using a Fischer-Tropsch catalyst.

U.S. Pat. No. 4,046,829 discloses a method for producing hydrocarbons from coal using an iron based Fischer-Tropsch catalyst. Coal is gasified and synthesis gas formed is gas scrubbed and subsequently subjected to partial oxidation with oxygen. After the Fischer-Tropsch conversion of synthesis gas low hydrocarbons are separated, recycled and after carbon dioxide removal mixed with synthesis gas prior to the partial oxidation.

U.S. Pat. No. 4,433,065 discloses a process for producing hydrocarbons from coal using a cobalt based Fischer-Tropsch catalyst. After removal of liquid hydrocarbons the gas phase is subject to carbon dioxide removal. After separation a hydrogen comprising stream is recycled to the partial oxidation process, a light hydrocarbons comprising stream is recycled to the coal gasification process, and a carbon monoxide comprising stream is subjected to combustion for electricity generation.

U.S. Pat. No. 5,324,335 discloses a process for producing hydrocarbons using an iron-based Fischer-Tropsch catalyst in which hydrocarbon containing gas is subjected to steam reforming for producing synthesis gas. After carbon dioxide removal the synthesis gas is subjected to the Fischer-Tropsch conversion. Light hydrocarbons are separated, recycled and mixed with the synthesis gas.

SUMMARY OF THE INVENTION

The invention is directed to a process for the production of hydrocarbons from gaseous hydrocarbonaceous feed comprising the steps of:

i) partially oxidating the gaseous hydrocarbonaceous feed and oxygen containing gas at elevated temperature and pressure into synthesis gas;

ii) catalytically converting the synthesis gas of step i) using a cobalt based Fischer-Tropsch catalyst into a hydrocarbons comprising stream;

iii) separating the hydrocarbons comprising stream of step ii) into a hydrocarbons product stream and a recycle stream; and, iv) removing carbon dioxide from the recycle stream and recycle of carbon dioxide depleted recycle stream to step i).

DETAILED DESCRIPTION OF THE INVENTION

The invention is directed to a process for the production of relatively high hydrocarbons using a cobalt Fischer-Tropsch catalyst. More particularly, the invention concerns a cobalt catalyst, especially a cobalt-zirconia catalyst, which is favorable for producing a relatively large amount of hydrocarbons in the $C_{10}$-$C_{14}$ range beside a lighter and a heavier fraction. This favor for $C_{10}$-$C_{14}$ hydrocarbons, especially unsaturated hydrocarbons, results, however, in a higher production of offgas when compared with a process which is optimal for the production of the most heavy paraffinic products. In modern plant design this offgas may not be flared but rather is to be used or reprocessed.

According to the process of the invention, the hydrocarbons comprising stream is separated into a hydrocarbons product stream and a recycle stream. Carbon dioxide is removed from the recycle stream and the carbon dioxide depleted recycle stream is used as a feed for the partial oxidation conversion Preferably at least 70 vol. % of carbon dioxide is removed, more preferably at least 80 vol. %, even more preferably at least 90 vol. %. The recycle stream comprises predominantly hydrogen, carbon monoxide, $C_1$ to $C_3$ hydrocarbon, in some cases also $C_4$ and minor amounts of $C_{5+}$ hydrocarbon and inerts as nitrogen noble gasses.

A reprocessing of the recycle stream without prior carbon dioxide removal would have resulted in synthesis gas having a low $H_2$/CO ratio which is inappropriate for use in the Fischer-Tropsch conversion of synthesis gas into the desired hydrocarbons. Direct use of the recycle stream in the partial oxidation conversion would provide synthesis gas with a level of inerts that is too high Removal of carbon dioxide prior to use in the partial oxidation conversion will reduce the level of inerts in the synthesis gas produced. Use of the carbon dioxide depleted recycle stream in turn results in the use of less oxygen in the partial oxidation conversion. The recycle stream optimizes the carbon efficiency of the process. This in its turn increases the thermal efficiency of the process. Finally, removal of carbon dioxide costs less than a conversion of carbon dioxide into carbon monoxide.

According to the invention, a cobalt based Fischer-Tropsch catalyst may be used. In particular, the catalyst may be a cobalt on zirconia catalyst, which is favorable for the production of $C_{10}$-$C_{14}$ hydrocarbons wherein the offgas produced does not result in an extensive increase of costs and the amount of carbon dioxide to be removed is minimal due to the use of gaseous hydrocarbonaceous feed which results in a lower production of carbon dioxide.

The process of recycling the carbon dioxide depleted recycle stream is simplified if this carbon dioxide depleted recycle stream is first compressed, mixed with gaseous hydrocarbonaceous feed and subsequently introduced in the partial oxidation conversion using oxygen containing gas.

In order to avoid a build-up of inerts in the process, it is preferred that part of the recycle stream of step iii), e.g. between 5 and 50 vol. %, preferably between 10 and 40 vol %, of the total stream, is used as fuel in steam reforming of gaseous hydrocarbonaceous feed for producing hydrogen supplement for synthesis gas of step i).

Accordingly, inerts such as carbon dioxide and nitrogen are removed from the process after combustion as flue gas and the hydrogen or hydrogen rich synthesis gas produced in the SMR process may be used for adjusting the $H_2$/CO ratio of the synthesis gas.

According to a further preferred embodiment part of the recycle stream of step iii) or step iv) is used as fuel for power generation.

Finally, it is preferred that the hydrocarbons product stream is subjected to catalytic hydrocracking. Accordingly, the molecular weight distribution of hydrocarbons produced may be adjusted as desired.

The hydrocarbonaceous feed suitably is methane, natural gas, associated gas or a mixture of $C_{1-4}$ hydrocarbons. The feed comprises mainly, i.e. more than 90 v/v %, especially more than 94%, $C_{1-4}$ hydrocarbons, especially comprises at least 60 v/v percent methane, preferably at least 75 percent, more preferably 90 percent. Very suitably natural gas or associated gas is used. Suitably, any sulphur in the feedstock is removed.

The (normally liquid or solid) hydrocarbons produced in the process and mentioned in the present description are suitably $C_{3-100}$ hydrocarbons, more suitably $C_{4-60}$ hydrocarbons, especially $C_{5-40}$ hydrocarbons, more especially $C_{6-20}$ hydrocarbons, or mixtures thereof. These hydrocarbons or mixtures thereof are liquid or solid at temperatures between 5 and 30° C. (1 bar), especially at 20° C. (1 bar), and usually are paraffinic of nature, while up to 30 wt %, preferably up to 15 wt %, of either olefins or oxygenated compounds may be present.

The partial oxidation of gaseous feedstocks, producing mixtures of especially carbon monoxide and hydrogen, can take place in the oxidation unit according to various established processes. Catalytic as well as non-catalytic processes may be used. These processes include the Shell Gasification Process. A comprehensive survey of this process can be found in the Oil and Gas Journal, Sep. 6, 1971, pp 86-90. The partial oxidation process may be carried out in combination with a reforming process, e.g. in the form of an autothermal reforming process.

The oxygen containing gas is air (containing about 21 percent of oxygen), or oxygen enriched air, suitably containing up to 100 percent of oxygen, preferably containing at least 60 volume percent oxygen, more preferably at least 80 volume percent, more preferably at least 98 volume percent of oxygen. Oxygen enriched air may be produced via cryogenic techniques, but is preferably produced by a membrane based process, e.g. the process as described in WO 93/06041.

To adjust the $H_2$/CO ratio in the syngas, carbon dioxide and/or steam may be introduced into the partial oxidation process. Preferably up to 15% volume based on the amount of syngas, preferably up to 8% volume, more preferably up to 4% volume, of either carbon dioxide or steam is added to the feed. As a suitable steam source, water produced in the hydrocarbon synthesis may be used. As a suitable carbon dioxide source, carbon dioxide from the effluent gasses of the expanding/combustion step may be used. The $H_2$/CO ratio of the syngas is suitably between 1.5 and 2.3, preferably between 1.8 and 2.1. If desired, (small) additional amounts of hydrogen may be made by steam methane reforming, preferably in combination with the water shift reaction. Any carbon monoxide and carbon dioxide produced together with the hydrogen may be used in the hydrocarbon synthesis reaction or recycled to increase the carbon efficiency.

The percentage of hydrocarbonaceous feed which is converted in the first step of the process of the invention is suitably 50-99% by weight and preferably 80-98% by weight, more preferably 85-96% by weight.

The gaseous mixture, comprising predominantly hydrogen, carbon monoxide and optionally nitrogen, is contacted with a suitable catalyst in the catalytic conversion stage, in which the normally liquid hydro-carbons are formed. Suitably at least 70 v/v % of the syngas is contacted with the catalyst, preferably at least 80%, more preferably at least 90, still more preferably all the syngas.

The catalysts used for the catalytic conversion of the mixture comprising hydrogen and carbon monoxide into hydrocarbons are known in the art and are usually referred to as Fischer-Tropsch catalysts. The catalysts for use in the Fischer-Tropsch hydrocarbon synthesis process comprise, as the catalytically active component cobalt.

The catalytically active cobalt is preferably supported on a porous carrier. The porous carrier may be selected from any of the suitable refractory metal,oxides or silicates or combinations thereof known in the art. Particular examples of preferred porous carriers include silica, alumina, titania, zirconia, ceria, gallia and mixtures thereof, especially silica and titania.

The amount of catalytically active cobalt on the carrier is preferably in the range of from 3 to 300 pbw per 100 pbw of carrier material, more preferably from 10 to 80 pbw, especially from 20 to 60 pbw.

If desired, the cobalt based Fischer-Tropsch catalyst may also comprise one or more metals or metal oxides as promoters. Suitable metal-oxide promoters may be selected from Groups IIA, IIIB, IVB, VB and VIB of the-Periodic Table of Elements, or the actinides and lanthanides. In particular, oxides of magnesium, calcium, strontium, barium, scandium, yttrium, lanthanum, cerium, titanium, zirconium, hafnium, thorium, uranium, vanadium, chromium and manganese are most suitable promoters. Particularly preferred metal oxide promoters for the catalyst used to prepare the waxes for use in the present invention are manganese and zirconium oxide. Suitable metal promoters may be selected from Groups VIIB or VIII of the Periodic Table. Rhenium and Group VIII noble metals are particularly suitable, with platinum and palladium being especially preferred. The amount of promoter present in the catalyst is suitably in the range of from 0.01 to 100 pbw, preferably 0.1 to 40, more preferably 1 to 20 pbw, per 100 pbw of carrier.

The catalytically active cobalt and the promoter, if present, may be deposited on the carrier material by any suitable treatment, such as impregnation, kneading and extrusion. After deposition of the cobalt and, if appropriate, the promoter on the carrier material, the loaded carrier is typically subjected to calcination at a temperature of generally from 350 to 750° C., preferably a temperature in the range of from 450 to 550° C. The effect of the calcination treatment is to remove crystal water, to decompose volatile decomposition products and to convert organic and inorganic compounds to their respective oxides. After calcination, the resulting catalyst may be activated by contacting the catalyst with hydrogen or a hydrogen-containing gas, typically at temperatures of about 200 to 350° C.

The catalytic conversion process may be performed in the conversion unit under conventional synthesis conditions known in the art. Typically, the catalytic conversion may be effected at a temperature in the range of 150 to 350° C., preferably from 180 to 270° C. Typical total pressures for the catalytic conversion process are in the range of from 1 to 200 bar absolute, more preferably from 10 to 70 bar absolute. In the catalytic conversion process preferably (at least 50 wt % of $C_5$+, preferably 70 wt %) $C_{5-20}$ hydrocarbons are formed.

The amount of $C_{10}$-$C_{14}$ which is directly formed in step ii) of the process is suitably between 12 and 27 wt % of the $C_5$+ product stream, preferably between 17 and 27 wt %, more preferably between 22 and 27 wt %. A high amount is preferred as the $C_{10}$-$C_{14}$ fraction is a valued LDF feedstock.

The average ASF value for the $C_5$+ product stream of the step ii) of the process according to the present invention is suitable between 0.95 and 0.80, preferably between 0.92 and 0.82, preferably between 0.90 and 0.85. Higher values will result in a relative low amount of $C_{10}$-$C_{14}$ fraction, lower values will result in too much $C_1$-$C_4$ products, which products have a low value. The ASF value can be optimized by changing reaction conditions, especially $H_2$/CO ratio and temperature, but also GHSV and pressure, and by a suitable choice of the catalyst. Especially a cobalt on zirconia carrier is suitable. The relative low ASF value (when compared with Fischer Tropsch processes directed to wax production) result in a relative large gas fraction to be recycled. $CO_2$ removal is especially suitable under those conditions.

The process according to the present invention is especially suitable for Fischer Tropsch plants which use a two or three stage Fischer Tropsch process. The relative low ASF values not only directly result in a large amount of $C_1$-$C_4$ products, but these large amounts of gas also result (keeping any other variables the same) in an indirect increase of the $C_1$-$C_4$ fraction in the second and third stage ($H_2$/CO ratio and GHSV).

The cobalt based Fischer-Tropsch catalyst used, yields substantial quantities of paraffins, more preferably substantially unbranched paraffins. A part may boil above the boiling point range of the so-called middle distillates. The term "middle distillates", as used herein, is a reference to hydrocarbon mixtures of which the boiling point range corresponds substantially to that of kerosene and gas oil fractions obtained in a conventional atmospheric distillation of crude mineral oil. The boiling point range of middle distillates generally lies within the range of about 150 to about 360° C.

The higher boiling range paraffinic hydrocarbons, if present, may be isolated and subjected in an optional hydrocracking unit to a catalytic hydrocracking which is known per se in the art, to yield the desired middle distillates. The catalytic hydro-cracking is carried out by contacting the paraffinic hydrocarbons at elevated temperature and pressure and in the presence of hydrogen with a catalyst containing one or more metals having hydrogenation activity, and sup-ported on a carrier. Suitable hydrocracking catalysts include catalysts comprising metals selected from Groups VIB and VIII of the Periodic Table of Elements. Preferably, the hydrocracking catalysts contain one or more noble metals from group VIII. Preferred noble metals are platinum, palladium, rhodium, ruthenium, iridium and osmium. Most preferred catalysts for use in the hydro-cracking stage are those comprising platinum.

The amount of catalytically active metal present in the hydrocracking catalyst may vary within wide limits and is typically in the range of from about 0.05 to about 5 parts by weight per 100 parts by weight of the carrier material.

Suitable conditions for the optional catalytic hydrocracking in a hydrocracking unit are known in the art. Typically, the hydrocracking is effected at a temperature in the range of from about 175 to 400° C. Typical hydrogen partial pressures applied in the hydrocracking process are in the range of from 10 to 250 bar.

The process may conveniently and advantageously be operated in a recycle mode or in a single pass mode ("once through") devoid of any recycle streams. This single pass mode allowing the process to be comparatively simple and relatively low cost.

The recycle stream obtained after separation of the hydrocarbons may comprise normally gaseous hydrocarbons produced in the synthesis process, nitrogen, unconverted methane and other feedstock hydrocarbons, unconverted carbon monoxide, carbon dioxide, hydrogen and water. The normally gaseous hydrocarbons are suitably $C_{1-5}$ hydrocarbons, preferably $C_{1-4}$ hydrocarbons, more preferably $C_{1-3}$ hydrocarbons. These hydrocarbons, or mixtures thereof, are gaseous at temperatures of 5-30° C. (1 bar), especially at 20° C. (1 bar). Further, oxygenated compounds, e.g. methanol, dimethylether, may be present. For the removal of carbon dioxide any suitable conventional process may be used, for instance adsorption processes using amines, especially in combination with a physical solvent, such as the ADIP process or the SULFINOL process as described in inter alia GB 1,444,936; GB 1,131,989; GB 965,358; GB 957260; and GB 972,140. Suitably at least 70 vol. % of the carbon dioxide present is removed from the recycle stream, preferably 80 vol. %, more preferably 90 vol. %. Suitably, between 50 and 90 vol. % of the recycle stream is recycled to step i) of the process, preferably between 60 and 80 vol. %, in order to get an optimum balance between optimum carbon use, process efficiency and inert removal.

We claim:

1. A process for the production of hydrocarbons from gaseous hydrocarbonaceous feed comprising:

i) partially oxidating the gaseous hydrocarbonaceous feed with oxygen containing gas at elevated temperature and pressure into synthesis gas;

ii) catalytically converting the synthesis gas of step i) using a cobalt on zirconia carrier based Fischer-Tropsch catalyst into a hydrocarbon comprising stream;

iii) separating the hydrocarbon comprising stream of step ii) into a hydrocarbon product stream and a recycle stream; and, iv) removing carbon dioxide from the recycle stream and recycling the carbon dioxide depleted recycle stream to step i).

2. The process of claim 1, wherein the carbon dioxide depleted recycle stream is premixed with the gaseous hydrocarbonaceous feed.

3. The process of claim 1, wherein part of the recycle stream of step iii) is used as fuel in steam reforming of gaseous hydrocarbonaceous feed for producing hydrogen supplement for synthesis gas of step i).

4. The process of claim 1, wherein part of the recycle stream of step iii) or step iv) is used as fuel for power generation.

5. The process of claim 1, wherein the hydrocarbons product stream is subjected to catalytic hydrocracking.

6. The process of claim 1, wherein the hydrocarbon product stream comprises between 17 and 27 wt % $C_{10}$-$C_{14}$.

7. The process of claim 2, wherein part of the recycle stream of step iii) is used as fuel in steam reforming of gaseous hydrocarbonaceous feed for producing hydrogen supplement for synthesis gas of step i).

8. The process of claim 2, wherein part of the recycle stream of step iii) or step iv) is used as fuel for power generation.

9. The process of claim 2, the hydrocarbons product stream is subjected to catalytic hydrocracking.

10. The process of claim 2, wherein the hydrocarbon product stream comprises between 17 and 27 wt % $C_{10}$-$C_{14}$.

11. The process of claim 1, wherein the hydrocarbon product stream comprises between 22 wt % and 27 wt % $C_{10}$-$C_{14}$.

12. The process of claim 3, wherein part of the recycle stream stream of step iii) or step iv) is used as fuel for power generation.

13. The process of claim 3, wherein the hydrocarbons product stream is subjected to catalytic hydrocracking.

14. The process of claim 3, wherein the hydrocarbon product stream comprises between 17 and 27 wt % $C_{10}$-$C_{14}$.

15. The process of claim 4, wherein the hydrocarbons product stream is subjected to catalytic hydrocracking.

16. The process of claim 4, wherein the hydrocarbon product stream comprises between 17 and 27 wt % $C_{10}$-$C_{14}$.

17. The process of claim 5, wherein the hydrocarbon product stream comprises between 17 and 27 wt % $C_{10}$-$C_{14}$.

* * * * *